US009764454B2

(12) United States Patent
Thommes et al.

(10) Patent No.: US 9,764,454 B2
(45) Date of Patent: Sep. 19, 2017

(54) TOOL FOR INSERTING OR REMOVING A TANG-FREE WIRE THREAD INSERT, PRODUCTION METHOD THEREFOR AND METHOD FOR MANUALLY REPLACING AN ENTRAINING BLADE OF THIS TOOL

(75) Inventors: Holger Thommes, Strohn (DE); Uwe Kirchhecker, Steinhagen (DE); Andreas Marxkors, Hövelhof (DE)

(73) Assignee: Böllhoff Verbindungstechnik GmbH (DE)

( * ) Notice: Subject to any disclaimer, the term of this patent is extended or adjusted under 35 U.S.C. 154(b) by 819 days.

(21) Appl. No.: 14/126,747

(22) PCT Filed: Jun. 22, 2012

(86) PCT No.: PCT/EP2012/062141

§ 371 (c)(1),
(2), (4) Date: Mar. 21, 2014

(87) PCT Pub. No.: WO2013/007498

PCT Pub. Date: Jan. 17, 2013

(65) Prior Publication Data

US 2014/0373326 A1 Dec. 25, 2014

(30) Foreign Application Priority Data

Jul. 14, 2011 (DE) ..... 10 2011 051 846

(51) Int. Cl.
*B25B 27/14* (2006.01)

(52) U.S. Cl.
CPC ..... *B25B 27/143* (2013.01); *Y10T 29/53691* (2015.01); *Y10T 279/17786* (2015.01); *Y10T 403/60* (2015.01); *Y10T 403/602* (2015.01)

(58) Field of Classification Search
CPC ..... B25B 27/143; Y10T 29/53691; Y10T 403/59; Y10T 403/591; Y10T 403/595;
(Continued)

(56) References Cited

U.S. PATENT DOCUMENTS 62,057 A * 2/1867 Nellis ..... B23B 31/113 279/79
1,963,462 A * 6/1934 Brock ..... B25G 3/18 279/79

(Continued)

FOREIGN PATENT DOCUMENTS

CN 2925771 Y 7/2007
CN 201736184 U 2/2011

(Continued)

OTHER PUBLICATIONS

How to intstal tangless insert and how it works (JYA website).*

(Continued)

*Primary Examiner* — Larry E Waggle, Jr.
*Assistant Examiner* — Mahdi H Nejad
(74) *Attorney, Agent, or Firm* — Barclay Damon, LLP

(57) ABSTRACT

A tool for inserting or removing a tang-free wire thread insert is described, the entraining blade of which is manually fastenable and replaceable within the axial recess of the spindle body by means of a latching connection. In addition to the secure removal of wire thread inserts, this tool construction also ensures a quick replacement of worn entraining blades of the tool. Furthermore, a production method for such a tool is described.

34 Claims, 11 Drawing Sheets

Figure 1:
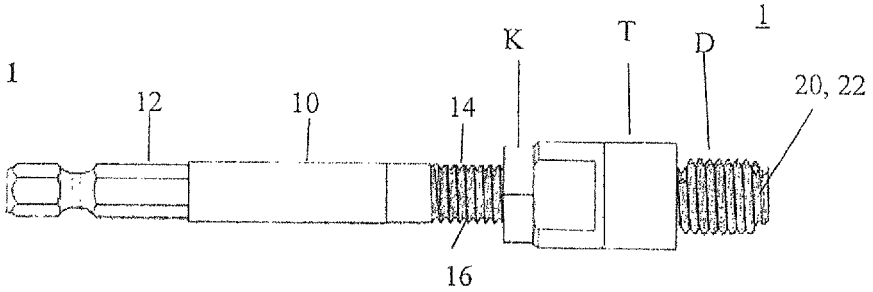

(58) Field of Classification Search
CPC ..... Y10T 403/599; Y10T 403/60; Y10T 403/602; Y10T 403/604; Y10T 403/606; Y10T 279/17786; F16B 37/12
USPC ..... 29/240.5; 279/79; 403/321, 322.1, 403/322.4, 325, 326, 327, 328, 329
See application file for complete search history.

(56) References Cited

U.S. PATENT DOCUMENTS

| | | | | | |
|---|---|---|---|---|---|
| 2,111,785 | A | * | 3/1938 | Kittrell | E21B 10/44 175/392 |
| 3,153,852 | A | * | 10/1964 | Freeman | B26B 7/005 279/79 |
| 3,246,930 | A | * | 4/1966 | Krekeler | E21C 35/19 279/79 |
| 3,861,039 | A | * | 1/1975 | Truax | B26B 7/005 30/277.4 |
| 6,000,114 | A | * | 12/1999 | Newton | B25B 27/143 29/240.5 |
| 9,421,676 | B2 | * | 8/2016 | Hondo | B25B 27/143 |

FOREIGN PATENT DOCUMENTS

| | | | | |
|---|---|---|---|---|
| CN | 201769170 | U | | 3/2011 |
| EP | 0 153 266 | A2 | | 8/1985 |
| EP | 0 153 266 | B1 | | 8/1985 |
| EP | 0 153 267 | B1 | | 1/1990 |
| EP | 0 615 818 | B1 | | 2/1994 |
| EP | 0 615 818 | A1 | | 9/1994 |
| EP | 0615818 | A1 | * | 9/1994 |
| EP | 1 132 174 | A1 | | 9/2001 |
| EP | 1838499 | | * | 10/2007 |
| EP | 1838499 | B1 | * | 10/2007 |
| EP | 1 838 499 | B1 | | 8/2008 |
| JP | 11-333751 | A | | 12/1999 |
| JP | 2012-101296 | A | | 5/2012 |
| JP | 2012101296 | A | * | 5/2012 |
| JP | 2015062990 | A | * | 4/2015 |
| JP | 2016117123 | A | * | 6/2016 |
| WO | WO 01/14105 | A1 | | 3/2001 |
| WO | WO 2006/077120 | A1 | | 7/2006 |

OTHER PUBLICATIONS

KATO One Pawl Fits All—Five Tools. One Pawl; http://www.katonet.com/pawl.html.*
KATO Removal Tools work with Heli-Coil _sup_®__sup_& Recoil inserts; http://www.katonet.com/removal.html.*
KATO Tangless Inserts; www.jeveka.com.*
Avanex Products—CT—Tangless.*
KATO Design Manual High; Avanex, KATO Authorized Distributor.*
KATO Hand Tools work with Heli-Coil® & Recoil inserts; http://www.katonet.com/hand.html.*
KATO CoilThread Tooling Guide; www.katonet.com.*
Japanese Office Action for JP 2014-519483 dated: Jan. 6, 2015;4 pages.
Chinese Office Action and Search Report for CN 201280034833.9; dated: Oct. 31, 2014;15 pages.
International Search Report and Written Opinion for PCT/EP2012/062141; dated Sep. 17, 2012; 9 pages.
International Preliminary Report on Patentability for PCT/EP/2012/062141; dated Jan. 14, 2014; 7 pages.

* cited by examiner

TOOL FOR INSERTING OR REMOVING A TANG-FREE WIRE THREAD INSERT, PRODUCTION METHOD THEREFOR AND METHOD FOR MANUALLY REPLACING AN ENTRAINING BLADE OF THIS TOOL

CROSS-REFERENCE TO RELATED APPLICATION

This application is a national stage application pursuant to 35 U.S.C. §371 of International Application No. PCT/EP2012/062141, filed Jun. 22, 2012, which claims priority upon German Patent Application No. 10 2011 051 846.0, filed Jul. 14, 2011, the entire contents of each application herein being incorporated by reference.

FIELD OF THE INVENTION

The present invention relates to a tool for inserting or removing a tang-free wire thread insert, a production method therefor as well as a method for manually replacing an entraining blade in such a tool.

BACKGROUND OF THE INVENTION

In the state of the art, different tools are known for inserting or removing wire thread inserts. Such tools comprise a spindle body, which normally has a drive section and a receiving section with thread for screwing on the wire thread insert. An entraining blade is arranged inside this spindle body. This entraining blade represents an elongated construction with a central pivot point. This central pivot point is also often the fastening point of the entraining blade, which is formed by a pin riveted in the spindle body. A blade projection, which engages in the wire thread insert, is arranged on one end of the entraining blade. A spring is arranged on the other end of the entraining blade so that the blade projection is pretensioned in a spring-loaded manner into an engaging position in the wire thread insert.

Such tools are described in EP 0 153 266, EP 0 153 267, U.S. Pat. No. 6,000,114 and EP 0 615 818.

A similar tool is disclosed in EP 1 838 499. The entraining blade arranged in the spindle body is also pretensioned in a spring-loaded manner here. The movement of the entraining blade takes place via a knife edge bearing so that the entraining blade does not need to be riveted with a pin within the spindle body.

Due to the blade construction in the tools of the state of the art described above, the entire tool is relatively long. A certain working space is thereby required for the installation and deinstallation of wire thread inserts, which is disadvantageous in some installation situations. Moreover, the entraining blades, in particular the blade projections, wear out after a certain number of inserting and/or removing cycles for wire thread inserts. A replacement of the entraining blade is thus required in order to be able to continue to use the tool. This replacement of the entraining blade is complex since the middle pin must be removed for the fastening of the entraining blade using different tools. If the entraining blade is not fastened with a middle pin, a tool is required in order to open the spindle body for removal of the entraining blade. The subsequent installation of the new entraining blade with pin is also only possible with a tool and a relatively considerable amount of time so that valuable operating time of the tool is thereby lost.

An additional constructive disadvantage comes from the arrangement of the spring, which pretensions the blade projection of the entraining blade into the engaging position in the wire thread insert. The spring can be lost during the deinstallation and/or the installation of the entraining blade or at least impede the retrofitting due to its required rearrangement.

It is thus the object of the present invention to provide a tool for inserting or removing a tang-free wire thread insert as well as a production method therefor, which is adjustable with little maintenance effort for a new work cycle.

SUMMARY OF THE INVENTION

The above object is solved through a tool, an entraining blade, a production method for this tool as well as through a method for manually replacing an entraining blade according to the appended claims. Advantageous designs of the present invention arise from the following description, the accompanying drawings and the claims.

The tool according to the invention for installing or removing a tang-free wire thread insert comprises the following features: a spindle body with a drive section and receiving section, wherein the receiving section has a thread for screwing on or a threadless surface for receiving the wire thread insert, an entraining blade, which is arranged in an axial recess of the receiving section and which is spring-mounted in an engaging position by a spring in the radial direction, so that a wire thread insert is engageable by the entraining blade, while the entraining blade is manually fastenable and replaceable in the axial recess with the help of a fastening connection between the entraining blade and the spindle body.

The tool according to the invention differs from the state of the art through the construction and handling of the entraining blade, with the help of which the wire thread inserts can be inserted and removed. While this entraining blade is installed in the spindle body, it can also be replaced without a tool in contrast to the state of the art. While in the case of tools of the state of the art for example a feedthrough and a hammer for removing a pin holding the blade is required, the entraining blade of the present invention can be removed with the help of the finger or the fingernail of the worker or a pen. Neither a tool nor complex and time-consuming working steps are needed. This tool-less replacement is based on the fastening of the entraining blade within the spindle body with the help of a fastening connection. The fastening connection can be established and also released again manually so that an entraining blade can be removed from the spindle body at any time and can be replaced by a new entraining blade. Through this construction of the entraining blade and its fastening in the spindle body, the maintenance effort for the tool described above is greatly reduced compared to the state of the art. But at the same time, the usual functionality of the tool for inserting or removing a wire thread insert is retained.

According to a preferred embodiment, the entraining blade comprises a negative or a positive fastening contour, which works together with a suitably designed mounting contour of the spindle body within the recess. Based on this embodiment, the entraining blade has an appendage progressing in the axial direction as positive fastening contour, which engages in a suitable opening within the recess of the spindle body. This suitable opening forms accordingly the negatively designed mounting contour of the spindle body. Vice versa, it is also conceivable to equip the entraining blade on its end facing the recess with an opening as a negative fastening contour, in which a pin-like appendage is receivable within the recess of the spindle body. This pin-like appendage of the spindle body forms accordingly the positive mounting contour of the spindle body.

The present invention also comprises a tool for installing or removing a tang-free wire thread insert, which comprises the following features: a spindle body with a drive section and a receiving section, wherein the receiving section has a thread for screwing on or a threadless surface for receiving the wire thread insert, an entraining blade, which is arranged in the axial recess of the receiving section and which is spring-mounted by a spring in an engaging position in the radial direction so that the wire thread insert is engageable through the entraining blade, while the entraining blade is designed as one piece with the spring.

The present tool according to the invention is specifically characterized by the special shape of the entraining blade, with the help of which the wire thread inserts can be inserted and removed. This entraining blade is also manually replaceable and thus does not require the tools necessary in the state of the art. The entraining blade is characterized in that it forms an integral structure with the spring pretensioning it. With the help of this construction, the number of individual parts of the tool is reduced and the mounting and maintenance effort is thus reduced. In the same manner as the tool described above, the entraining blade in combination with the spindle body is qualified by a fastening connection adapted for each other. Accordingly, the entraining blade has a negative or positive fastening contour, which works together with a suitably designed mounting contour of the spindle body within the recess. It is also preferred to implement the fastening connection as a latching connection, as explained in greater detail below. According to a further alternative, the entraining blade designed as one piece with a spring can also be installed permanently in the recess of the spindle body, as is generally known from the state of the art.

For establishing the aforementioned fastening connection between spindle body and entraining blade, the entraining blade preferably has on one side a latch bearing contour, with which the entraining blade is releasably latchable within the axial recess. This latch bearing contour is designed positively spring-loaded according to an embodiment, in particular U-shaped, or negatively spring-loaded according to a further embodiment, in particular O-shaped, and works together respectively with a counter bearing of the axial recess of the spindle body shaped complementary to the latch bearing contour.

For establishing the aforementioned latching connection according to the invention, the latch bearing contour of the entraining blade works together with a corresponding counter bearing of the spindle body. If the latch bearing contour is designed in a U-shaped manner, it encompasses the complementarily shaped counter bearing during the installation of the entraining blade in the spindle body. It is also conceivable to design the latch bearing contour in an O-shaped manner so that it is releasably latchable in a recess designed as a counter bearing.

In a different embodiment of the spindle body, the counter bearing is formed integrally in the spindle body within the axial recess or is fastened within the axial recess in the form of a separate part. In order to obtain an integrally formed counter bearing in the spindle body, it is shaped for example through eroding. The other alternative can be implemented by pressing in a corresponding counter bearing, which is then held within the axial recess via a press fit and forms a corresponding hold for the entraining blade latched on it. Besides the pressed in adapter, it is also preferable to install the pin progressing transversely to the longitudinal axis of the receiving section within the axial recess. The entraining blade can be fastened or respectively latched both on this adapter as well as on this transverse pin.

According to another preferred embodiment of the present invention, the axial recess within the spindle body is realized through a bore hole, in which a slotted support sleeve with a pin progressing transversely to the slot is fastened for the fastening of the entraining blade. With the help of this construction, meaning the pressing of a support sleeve with pin into the bore hole of the spindle body, complex eroding processes for creating the axial recess and the counter bearing can be spared. This reduces the production costs and also the time needed to produce the present tool.

According to another preferred embodiment of the present invention, the entraining blade in combination with a spring is designed in a U-shaped manner so that at least one U-leg is formed by the entraining blade and another U-leg is formed by the spring. This constructive design ensures on the one hand a compact and space-saving construction of the entraining blade with spring. It also ensures that the spring is not lost during deinstallation or installation of the entraining blade since it is connected with the entraining blade. In this connection, it is preferred that the entraining blade and the spring form an integral structure. A further installation space-saving advantage results from the fact that the entraining blade and spring are arranged parallel to each other. While the distant arrangement of spring and entraining blade used in the state of the art leads to an elongated tool, the compact, U-shaped construction of entraining blade and spring disclosed here realizes a short structure of the tool compared to the state of the art.

According to a further constructive design of the tool according to the invention, the spring comprises on its axial end a projection protruding radially outward, which extends in the longitudinal direction of the spring beyond a blade projection of the entraining blade. By means of this constructive alternative, it is ensured that the entraining blade is installed in its suitable alignment within the spindle body. For this purpose, the projection of the spring protruding radially outward blocks a faulty installation of the entraining blade in the spindle body. In this manner, the maintenance effort of the tool according to the invention is also reduced since a time-consuming deinstallation of an incorrectly installed entraining blade is prevented.

Furthermore, according to the invention, a production method for a tool for installing or removing a tang-free wire thread insert is disclosed, which has the following steps: producing a spindle body with a drive section and a receiving section with thread, creating an axial recess within the receiving section, preferably with a one-sided, radial window, producing an entraining blade and manually releasable connecting of the entraining blade via a fastening connection within the axial recess.

For producing the tool described above, it is essential to fasten the entraining blade within the spindle body in a releasably latchable manner. For this purpose, the entraining blade is constructively equipped with a fastening contour, preferably a latch bearing contour, which works together with a complementarily shaped counter bearing within the axial recess of the spindle body. On this constructive base, it is possible to remove the entraining blade from the axial recess without using a tool and to install a new entraining blade in a releasable manner within the axial recess, in particular to latch it there. Furthermore, it is preferred to facilitate the production of the tool described above in that the entraining blade in combination with a spring is produced, in particular eroded, as an integral U-shaped structure. The production of this construction ensures a compact structure of the tool and also prevents additional installation steps for the spring, which pretensions the entraining blade in the direction of the wire thread insert. Based on this construction, it is also ensured that during the deinstallation of the entraining blade the spring is not lost, since it is permanently connected with the entraining blade.

According to a further step in the present production method, a positive U-shaped latch bearing contour or a negative O-shaped latch bearing contour is preferably created on the entraining blade. Furthermore, according to a further embodiment of the production process according to the invention, the axial recess is eroded and the counter bearing within the axial recess is eroded or pressed in.

As an alternative design, it is also preferred to drill open the spindle body in the axial direction in order to insert a support sleeve with transverse pin into the created bore holes. The inserted support sleeve with transverse pin forms the axial recess with counter bearing, in which and on which the entraining blade with spring and positively U-shaped latch bearing contour are releasably fastenable.

The present invention also discloses a method for manually replacing an entraining blade in a tool for installing or removing a tang-free wire thread insert, which has the following constructive features: a spindle body with a drive section and a receiving section, wherein the receiving section has a thread for screwing on the wire thread insert, an entraining blade, which is arranged in an axial recess of the receiving section and which is spring-mounted in an engaging position by a spring in the radial direction so that a wire thread insert is engageable through the entraining blade, wherein the method has the following steps: manually gripping of the entraining blade in the axial recess, pulling of the entraining blade out of the axial recess and manually inserting and fastening, preferably latching, of another entraining blade in the axial recess.

The advantage of this method for manually replacing the entraining blade is that no tool is needed to be able to remove for example a worn or defective entraining blade from the spindle body and to replace it with a new entraining blade. This possibility is based on the construction basis that the entraining blade is fastened on a complementarily shaped counter bearing within the axial recess via a manually releasable fastening or latch bearing contour. It is thus possible to replace the entraining blade within the tool without a tool and in a short period of time.

BRIEF DESCRIPTION OF THE ACCOMPANYING DRAWINGS

Figure 2:
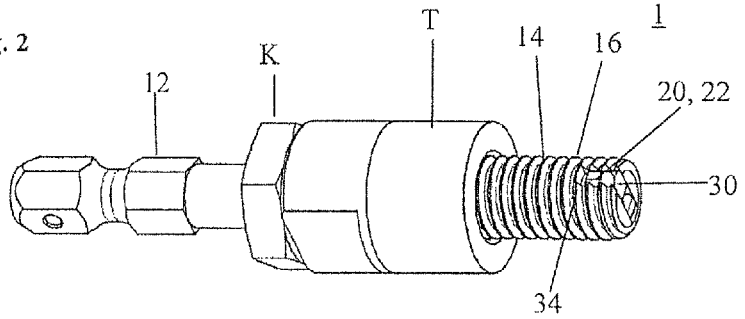
Figure 3:
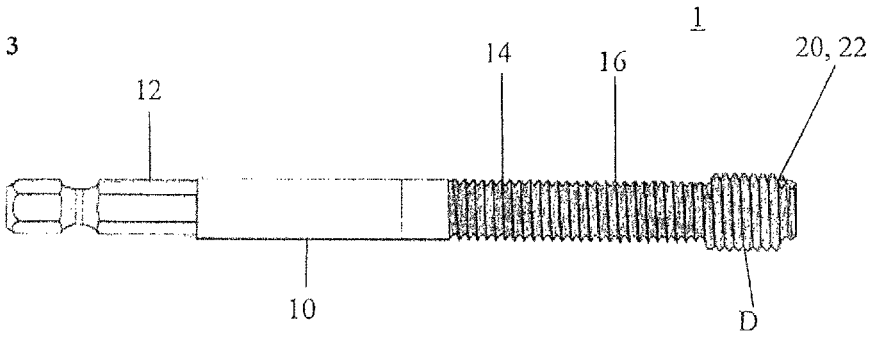
Figure 4:
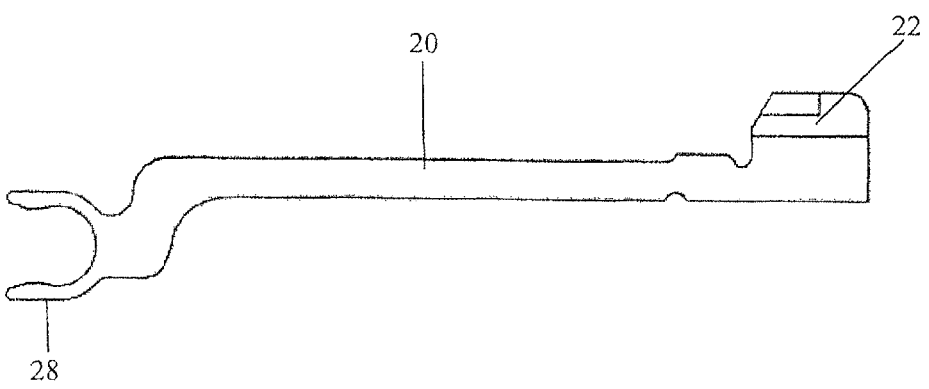
Figure 5:
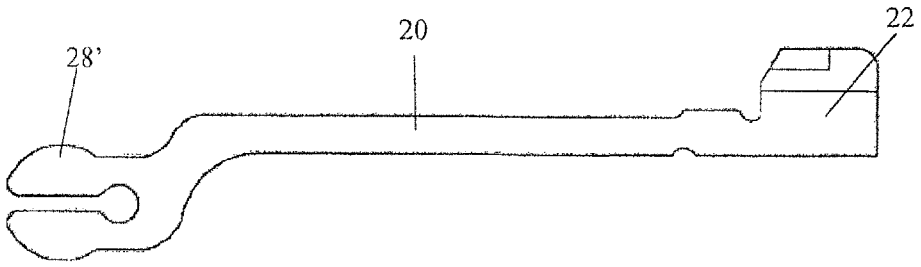
Figure 6:
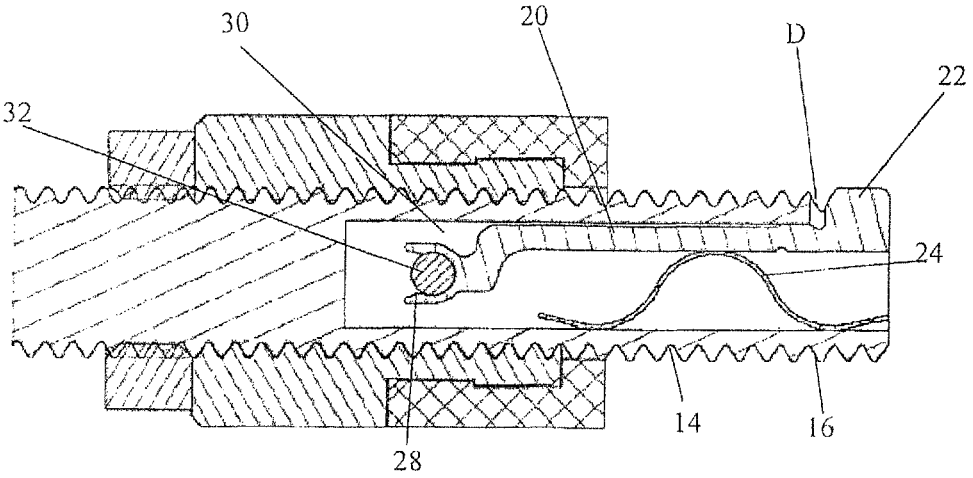
Figure 7:
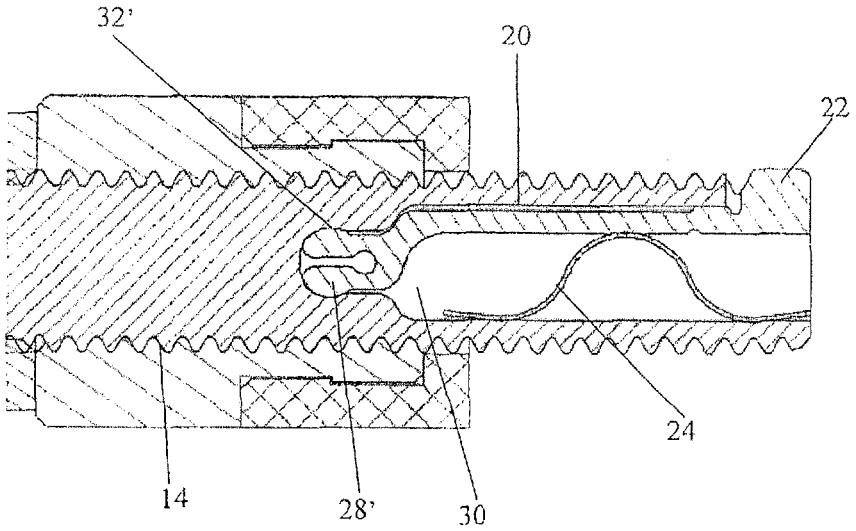
Figure 8:
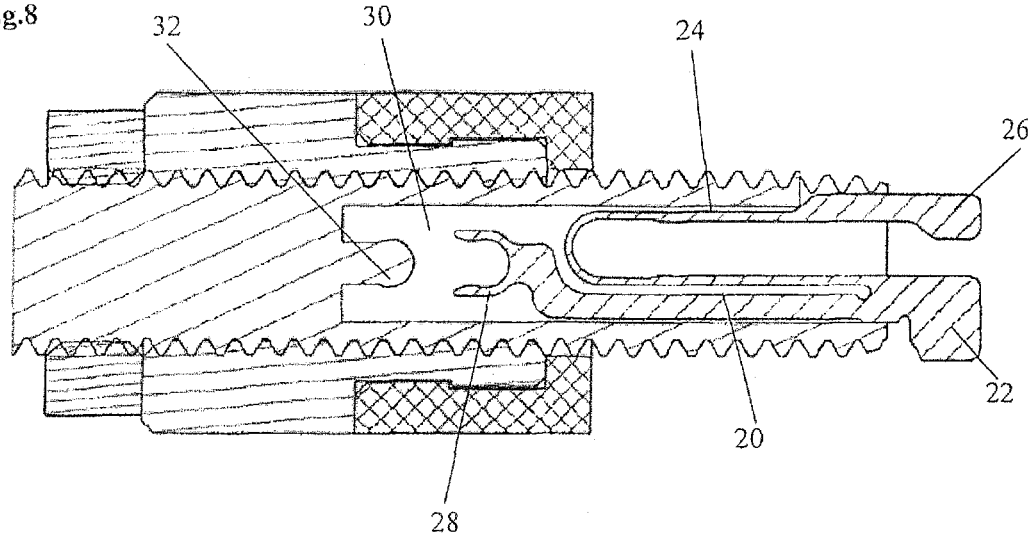
Figure 9:
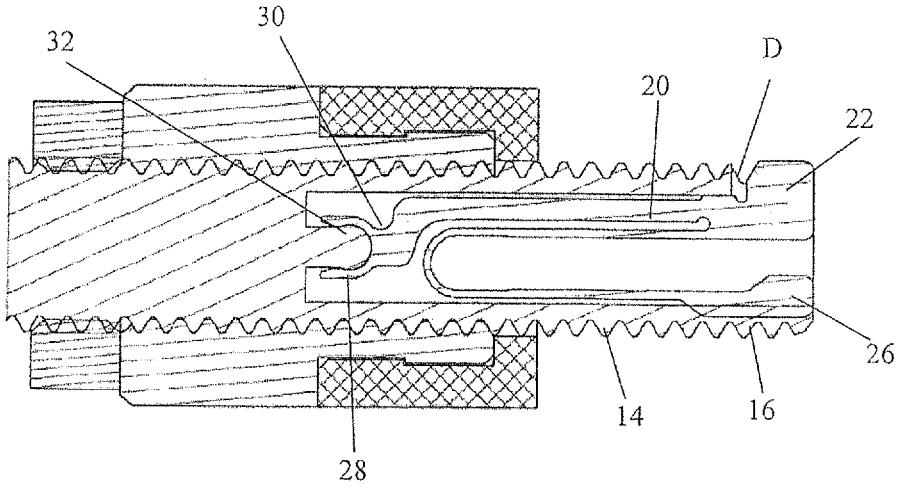
Figure 10:
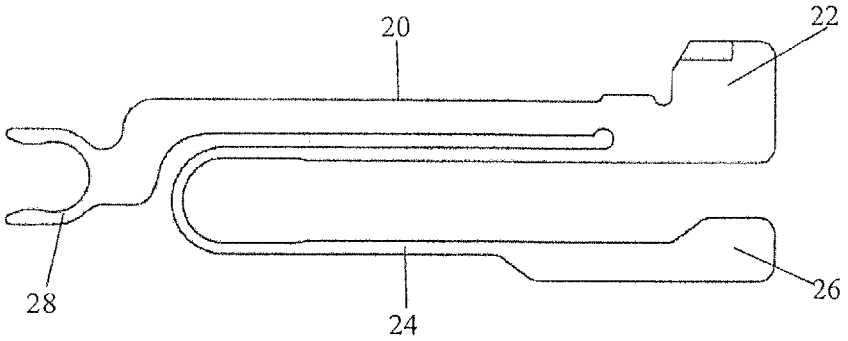
Figure 11:
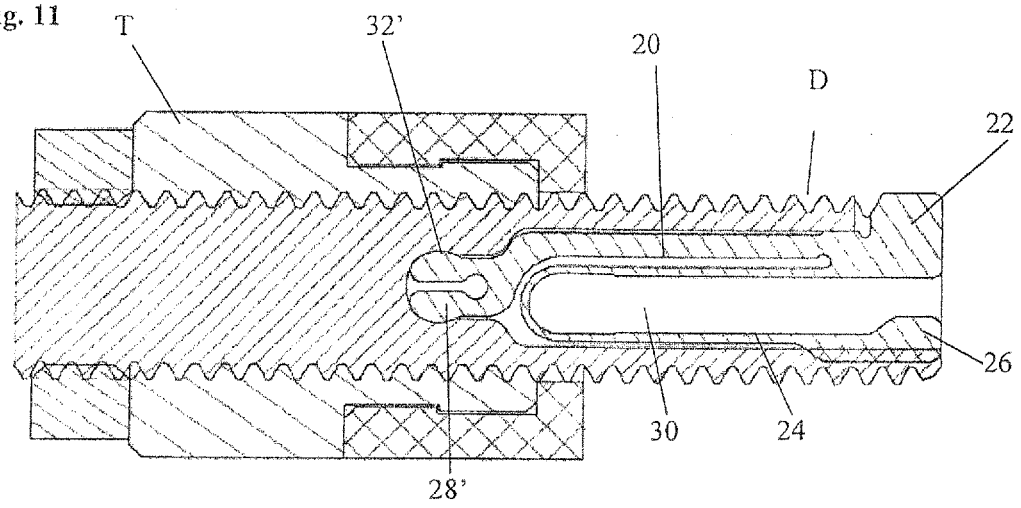
Figure 12:
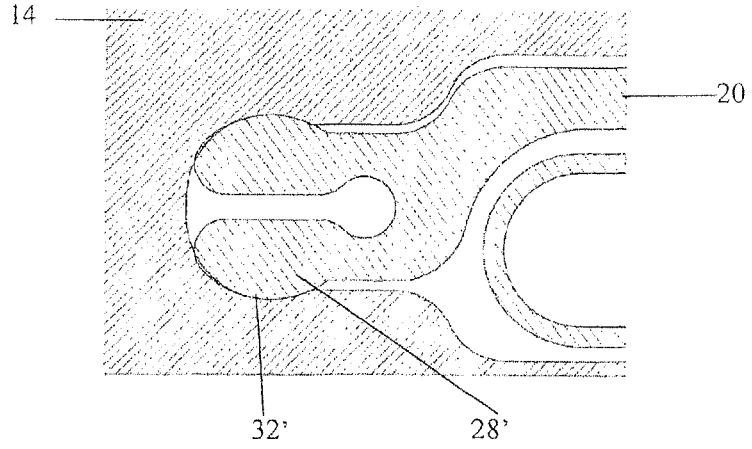
Figure 13:
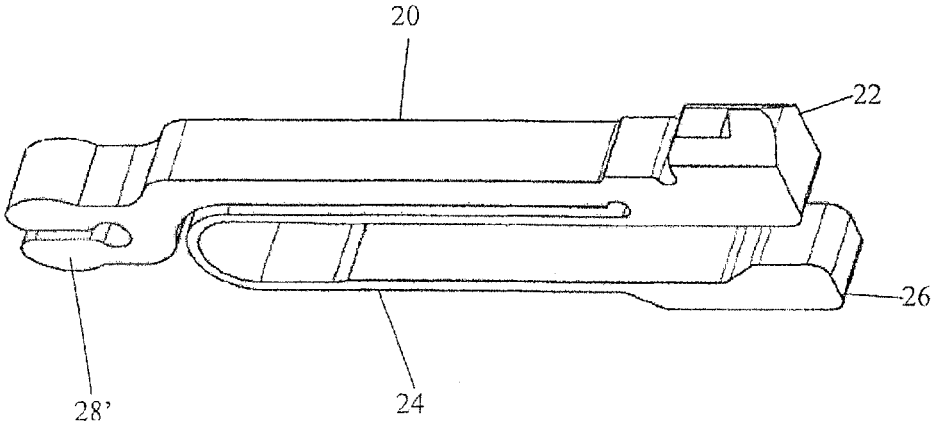
Figure 14:
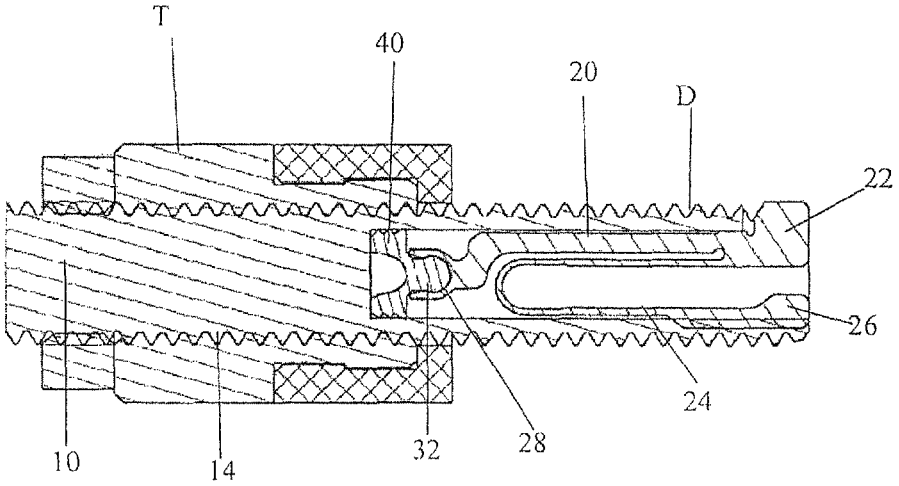
Figure 15:
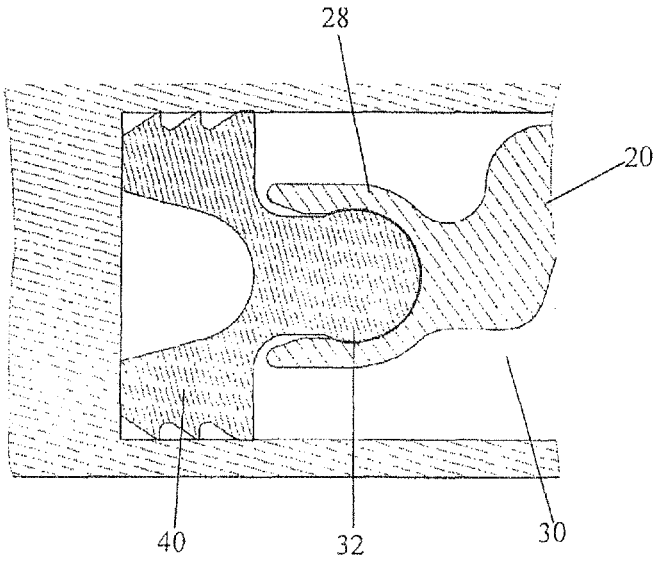
Figure 16:
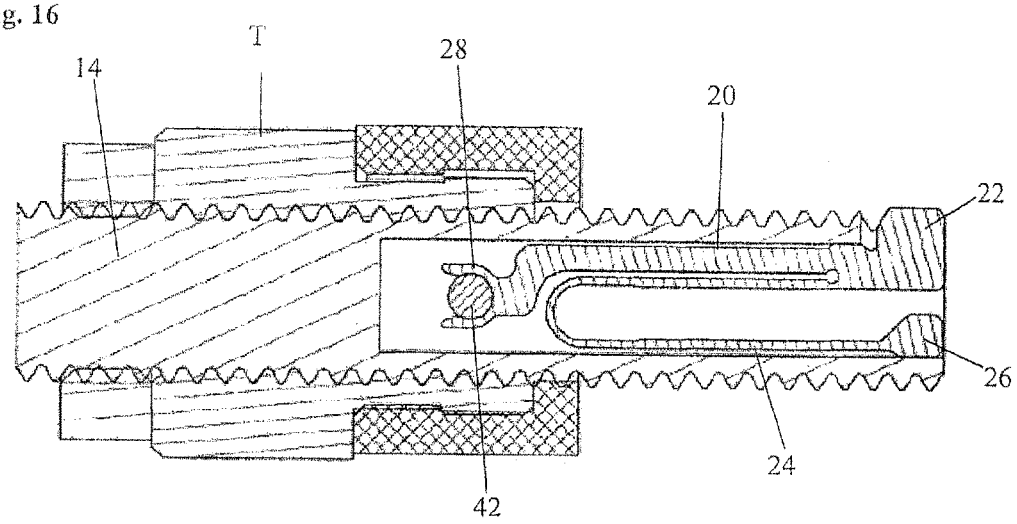
Figure 17:
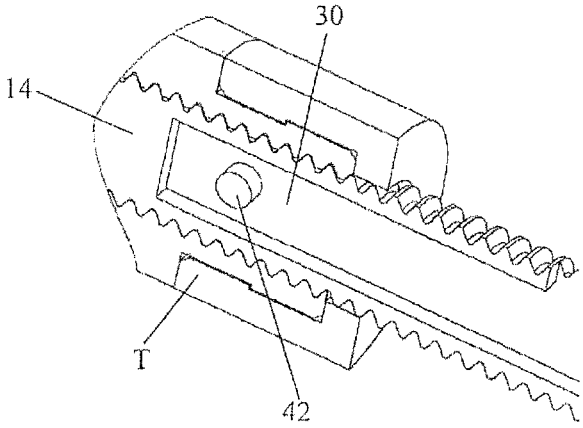
Figure 18:
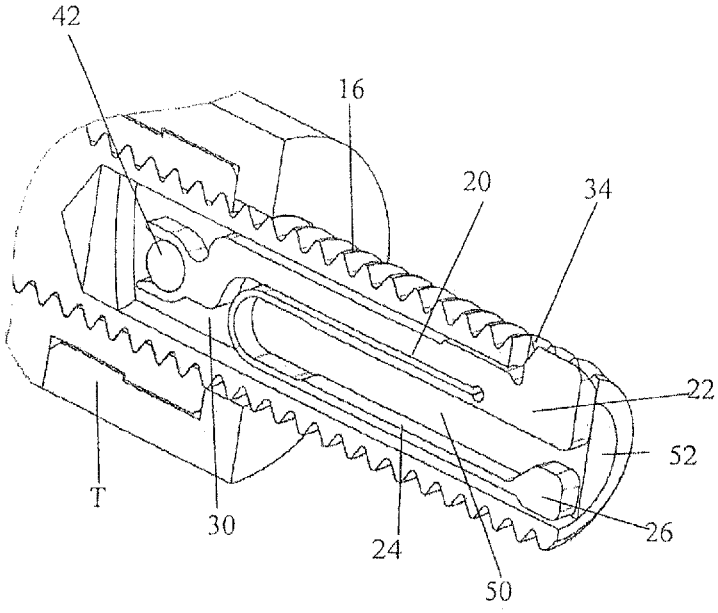
Figure 19:
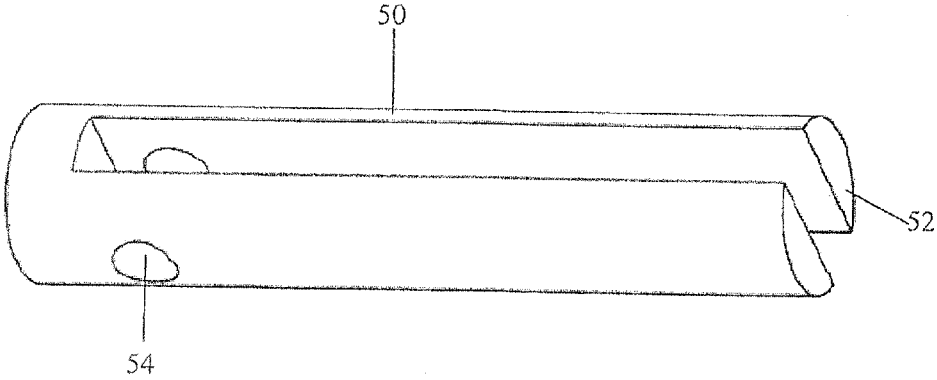
Figure 20:
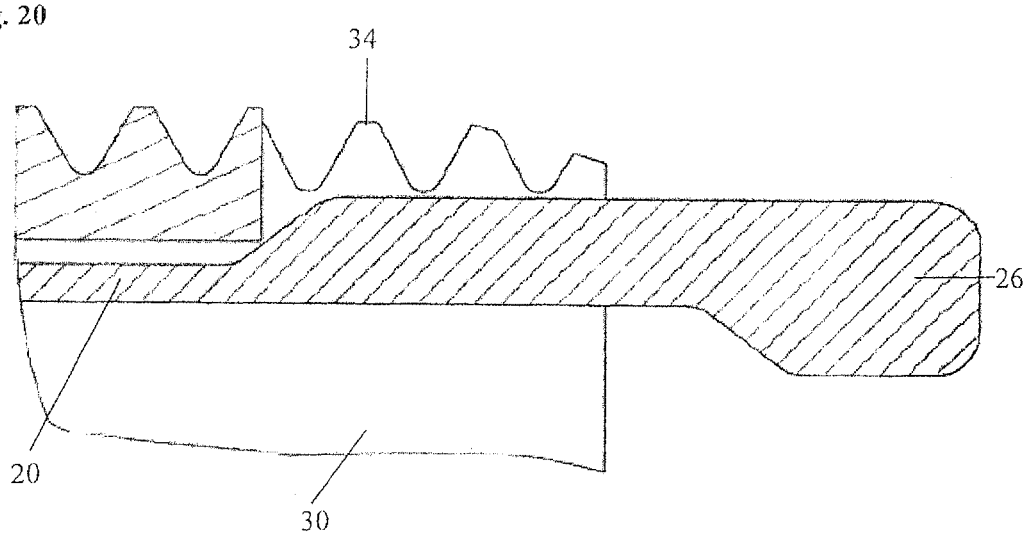
Figure 21:
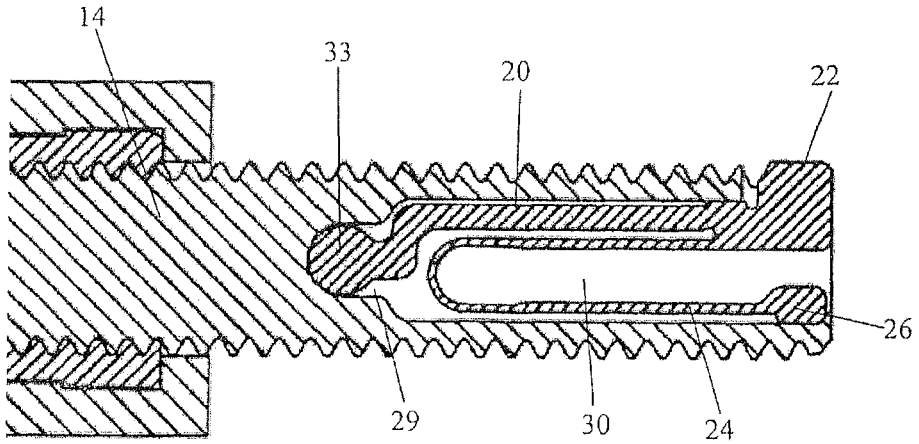
Figure 22:
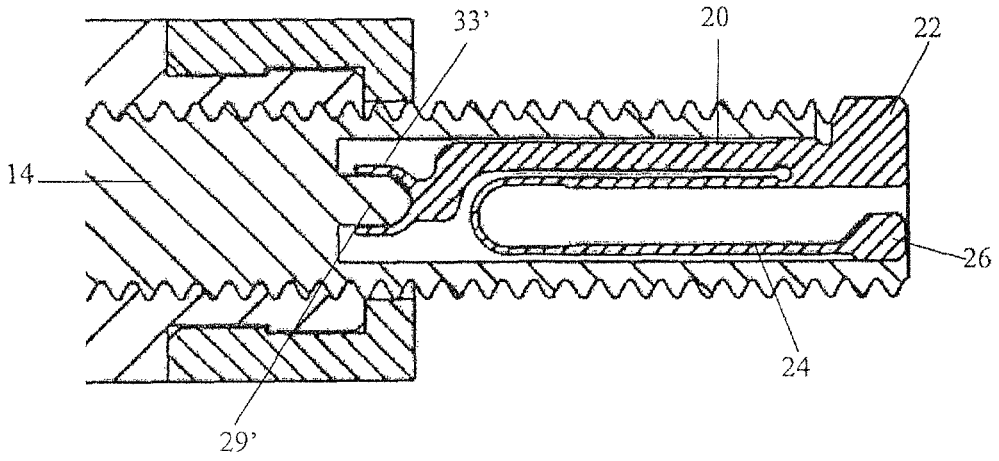
Figure 23:
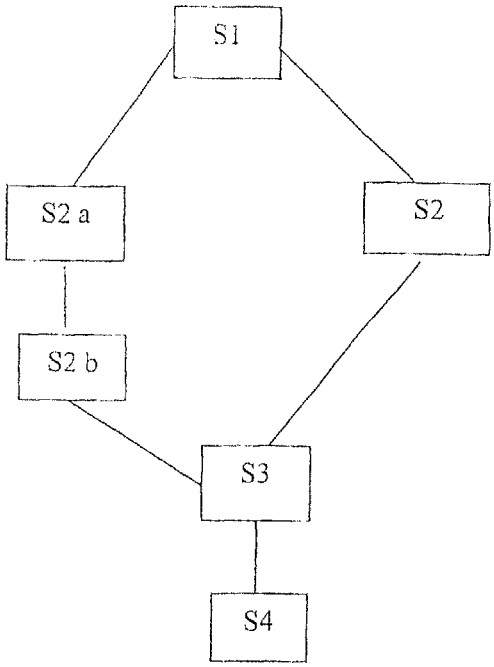
Figure 24:
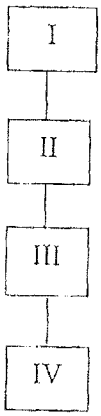

The preferred embodiments of the present invention are explained in greater detail with reference to the accompanying drawings. In the figures:

FIG. 1 shows a first preferred embodiment of the tool according to the invention, FIG. 2 shows a second preferred embodiment of the tool according to the invention, FIG. 3 shows a third preferred embodiment of the tool according to the invention, FIG. 4 shows a preferred embodiment of the entraining blade of the present invention, FIG. 5 shows a further preferred embodiment of the entraining blade of the present invention, FIG. 6 shows the entraining blade according to FIG. 4 in the installed state, FIG. 7 shows the entraining blade according to FIG. 5 in the installed state, FIG. 8 shows a schematic representation of the installation of the entraining blade in the tool, FIG. 9 shows a schematic representation of a preferred embodiment of the entraining blade installed in the tool, FIG. 10 shows a preferred embodiment of the entraining blade with spring according to the present invention, FIG. 11 shows a schematic representation of a further preferred embodiment of the entraining blade with spring in the installed state, FIG. 12 shows an enlarged representation of a section from FIG. 11, FIG. 13 shows a perspective representation of a preferred embodiment of the entraining blade with spring according to the present invention, FIG. 14 shows a further preferred embodiment of the tool according to the invention, FIG. 15 shows an enlarged representation of a section from FIG. 14, FIG. 16 shows a further preferred embodiment of the tool of the present invention, FIG. 17 shows an enlarged representation of a section from FIG. 16, FIG. 18 shows a perspective sectional representation of a further preferred embodiment of the tool of the present invention, FIG. 19 shows an enlarged representation of the support sleeve from FIG. 18, FIG. 20 shows a schematic enlarged section of a preferred spring construction of the present invention, FIG. 21 shows a preferred embodiment of the fastening of the entraining blade within the recess of the spindle body by means of a fastening contour, FIG. 22 shows another preferred design of the fastening of the entraining blade within the recess of the spindle body with a fastening contour, FIG. 23 a flow chart of a preferred production method for the tool according to the invention, FIG. 24 a flow chart of a preferred installation and deinstallation process for the entraining blade in the tool according to the invention

DETAILED DESCRIPTION OF THE PREFERRED EMBODIMENTS

The tool 1 shown as an example in FIG. 1-3 serves to install and remove a tang-free wire thread insert D in a threaded hole of a component (not shown). Since such wire thread inserts D as well as the manner in which they are screwed into a threaded hole are known, this will not be covered in greater detail.

The tool 1 according to the invention consists of a spindle body 10, a depth stop sleeve T with counter sleeve K, a receiving section 14 with thread 16 or a pin-like, threadless surface (not shown) and an entraining blade 20 with blade projection 22. According to FIG. 3, the tool 1 according to the invention can also be used without depth stop sleeve T and counter sleeve K. Below, the tool 1 is explained as an example with a receiving section 14 with thread 16. These explanations also apply in the same manner for the receiving section 14 with pin-like threadless surface (not shown), on which a wire thread insert is preferably clamped.

As can be seen based on FIGS. 1 and 3, the spindle body 10 seen from left to right is made up of a drive section 12, an intermediate section and a receiving section 14. The drive section 16 comprises a drive feature, for example a hexagon, which can be connected with a drive (not shown) for turning the spindle body 10.

The position of the depth stop sleeve T is freely adjustable on the thread 16 of the receiving section 14, where it is secured by means of the counter sleeve K.

The receiving section 14 has an axial recess 30, in which the entraining blade 20 is arranged. The axial recess 30 extends in the axial direction of the receiving section 14. It is preferably designed like a slot. The axial recess 30 is also open on the front side of the spindle body 10 adjacent to the receiving section 14 (see FIGS. 2 and 18). In the radial direction with respect to the spindle body 10, the axial recess 30 is open in the area of a window 34 adjacent to the aforementioned front side of the spindle body 10. The window 34 is preferably designed long enough so that a blade projection 22 of the entraining blade 20 can engage through the window 34 for engaging or abutting on the wire thread insert D. The radial outer wall of the axial recess 30 is designed closed with respect to the window 34.

Based on the construction of the entraining blade 20, as described in greater detail below, the length of the tool 1 can be set in any manner and reduced to a minimum. The entraining blade 20 is approximately half the length in comparison to the known entraining blades so that the length of the tool 1 is determined by the required dimensions of drive section 12 and threaded section 14. In this manner, the length of tool 1 can be adjusted in any manner for different installation conditions and customer needs.

The entraining blade 20 comprises the blade projection 22 already mentioned above, which engages through the radial window 34 on the wire thread insert D. The shape of the blade projection 22 can be designed differently, as is also known and will not be explained in greater detail.

As FIGS. 4, 5, 10 and 13 according to the preferred embodiment show, the entraining blade 20 comprises in addition to the blade projection 22 a latch bearing contour 28; 28'. By means of the latch bearing contour 28; 28' and a complementary shaped counter bearing 32; 32' in the axial recess 30, the entraining blade 20 is fastened in the axial recess 30 via a manually establishable and manually releasable latching connection. According to one embodiment, the latch bearing contour 28 is designed positively spring-loaded, preferably U-shaped so that it forms a positive connection with a pin-like counter bearing 32 (see FIG. 4, 6, 8, 9, 10, 14, 15, 16, 18). The counter bearing 32 is designed adjacent or near the axial end of the axial recess 30, which faces the drive section 12.

According to one embodiment, the counter bearing 32 consists of the aforementioned tang 32, which extends in the axial direction of the spindle body 10. According to another embodiment, the pin-like counter bearing 32 is formed by an adapter 40 with counter bearing 32, which is pressed, glued or otherwise fastened in the axial recess 30 (see FIGS. 14 and 15).

It is also preferred to releasably latch the U-shaped latch bearing contour 28 on a pin 42, which extends transversely to the longitudinal axis of the receiving section 14 through the axial recess 30 (see FIGS. 16, 17 and 18). The pin 42 is for example riveted, glued or otherwise fastened in the spindle body 10.

According to another preferred embodiment, which can be seen in FIGS. 18 and 19, the pin 42 is arranged in a support sleeve 50 transversely to its longitudinal direction. As seen in FIG. 18, the receiving section 14 was drilled open in the axial direction starting at the front side of the spindle body 10. The support sleeve 50 is fastened, preferably pressed or glued, into the created bore hole, which has a slot 52 progressing in the longitudinal direction. The slot 52 divides the support sleeve 50 into two opposite-lying legs progressing parallel to each other. The support sleeve 50 is closed on an axial front side, in the closer proximity of which the holes 54 are provided. In the holes 54, the pin 42 is arranged transversely to the longitudinal direction of the support sleeve 50 and the slot 52.

According to a constructive alternative to the embodiment described above, the pin 42 is fastened in the support sleeve 50 and the support sleeve 50 is permanently arranged in the aforementioned bore hole. Thus, a bore hole does not need to be provided in the receiving section 14 for the pin 42.

According to another constructive alternative, the pin 42 runs through the radial outer wall of the receiving section 14 as well as the support sleeve 50 and is fastened there.

The use of the support sleeve 50 with pin 42 has the advantage that the axial recess 30 can be produced through simple processing steps, such as boring, turning, milling and gluing in or pressing in. Naturally, it is also preferred to create the axial recess 30 through eroding in the receiving section 14.

According to a further embodiment, the latch bearing contour 28' is designed negatively so that it is releasably latched in a counter bearing 32' with an opening. The latch bearing contour 28' is preferably O-shaped as shown in FIG. 11-13. As can be seen based on FIG. 11-13, the latch bearing contour 28' comprises a middle gap so that two opposite-lying, spring-loaded legs are created. It is also conceivable to form the latch bearing contour 28' in a diamond-shaped manner and to adjust the shape of the counter bearing 32' accordingly in order to achieve a releasable latching.

According to different preferred embodiments of the present invention, the entraining blade 20 is designed with or without spring 24. Regardless of the spring 24, the entraining blade 20 is releasably latchable in the axial recess 30, as described above. FIGS. 4 and 5 show the entraining blade 20 without spring 24 with positive latch bearing contour 28 and negative latch bearing contour 28'. In the installed state, according to FIGS. 6 and 7, the entraining blade 20 is releasably fastened in the axial recess 30. A spring 24 arranged in the axial recess 30 thus pretensions the blade projection 22 into the engaging position in the wire thread inserts D so that the blade projection 22 extends through the window 34. The spring 24 is preferably fastened on the inside wall of the recess 30 or on the entraining blade 20 on at least one of the contact points between spring 24 and inside wall or between spring 24 and entraining blade 20.

According to another preferred embodiment, which is shown in FIGS. 8-16 and 18, the entraining blade 20 with the spring 24 forms an integral structure. This integral structure is preferably designed in a U-shaped manner so that the entraining blade 20 forms a U-leg and the spring 24 the opposite-lying U-leg. Also in this integral structure, the spring 24 pretensions the entraining blade 20 with blade projection 22 in the engaging position on the wire thread insert D so that the blade projection 22 extends through the window 34 (see above). According to a preferred embodiment, the integral structure of entraining blade 20 and spring 24 is wire-eroded so that it only takes up a small installation space.

As can be seen based on the enlarged representations in FIGS. 10, 13 and 18, the U-leg forming the spring 24 comprises a projection 26 on its axial end. The projection 26 preferably protrudes inwards with respect to the spindle body 10 or respectively extends in the direction of the blade projection 22. In the installed state of the integral structure of entraining blade 20 and spring 24, the radially inwards protruding projection 26 ensures that the blade projection 22 is supported during mechanical stress in the radial direction on the projection 26. The radially inwards protruding projection 26 is designed large enough that the blade projection 22 can only spring radially inwards far enough to release the wire thread insert D. This minimizes the mechanical stresses for the springing entraining blade 20. The radially inwards protruding projection 26 simultaneously contributes to the fact that the front-side opening of the axial recess 30 is closed to the greatest extent possible in order to reduce the inflow of dirt.

According to another preferred embodiment of the projection 26, it extends radially outward or respectively in the direction facing away from the blade projection 22 as well as in the longitudinal direction of the spring 24. The longitudinal extension of the projection 26 is greater than the axial length of the blade projection 22 with respect to the longitudinal direction of the entraining blade 20. Furthermore, it is preferred that the longitudinal extension of the projection 26 is greater than the axial length of the window 34 with respect to the receiving section 14 (see FIGS. 13 and 20). The axial recess 30 of the receiving section 14 is opened radially only on one side in the area of the window 34. If the integral structure of entraining blade 20 and spring 24 is inserted in the wrong direction so that the blade projection 22 is not arranged on the side of the window 34, it could happen that the integral structure is incorrectly installed in the axial recess 30. In order to avoid this, the projection 26 extends radially outward and in the axial direction in the manner described above. If the integral structure is now inserted such that the radially outwards protruding projection 26 is arranged in the window 34, the longitudinal extension of the projection 26 prevents the integral structure from being able to be installed. For installation, the entraining blade 20 and the spring 24 are namely moved towards each other until the back side of the blade projection 22 is supported on the radially inwards protruding projection 26. In this position, the radially outwards protruding projection 26 protrudes outwards far enough that the radial extent of the integral structure exceeds the inner opening of the axial recess 30. Another installation of the integral structure in the axial direction of the receiving section 14 is blocked by the end of the window 34 facing the drive section 12, as shown in FIG. 20. The projection 26 thus ensures the installation of the integral structure of entraining blade 20 and spring 24 in the suitable orientation.

According to the preceding description, in tool 1, the entraining blade 20 is fastened in the recess 30 of the spindle body 10 by means of a latching connection. It is also preferred to fasten the entraining blade 20 within the recess 30 of the spindle body 10 by means of a fastening connection 29, 33. This fastening connection 29, 33 does not represent a latching connection between the entraining blade 20 and the spindle body 10. Instead, this fastening connection should be understood on the one hand as the connections between spindle body 10 and entraining blade 20 known from the state of the art (not shown). This means that, by means of the fastening connection, the entraining blade 20 is installed within the recess 30 of the spindle body 10 by means of a tool. For this purpose, the entraining blade has a closed eyelet for example on its end protruding into the recess 30 so that the entraining blade is fastenable within the recess 30 by means of a pin running through the spindle body 10. This pin and thus also the entraining blade 20 is installed or deinstalled by means of a tool (not shown).

According to another preferred embodiment of the present invention, the fastening connection is a plug connection between entraining blade 20 and spindle body 10. The entraining blade 20 therein comprises a negative fastening contour 33, as is shown for example in FIG. 21. This negative fastening contour 33 is designed similar to an axial appendage or pin so that it extends in the axial longitudinal direction of the entraining blade and of the spindle body 10. The fastening contour 33 is preferably designed similar to a ball head in order to enable a pivoting or respectively springing movement of the entraining blade 20. It is also preferred to shape the fastening contour 33 similar to a pin so that the springing movement of the entraining blade 20 is only enabled through the springing material properties of the entraining blade 20. It is also preferred to shape the fastening contour 33 similar to a pin so that the springing movement of the entraining blade 20 is enabled solely by the springing material properties of the entraining blade 20. The negative fastening contour 33 of the entraining blade 20 engages in a complementary shaped negative fastening contour 29 of the spindle body 10 within the recess 30. In its simplest design, the negative fastening contour 29 of the recess 30 forms an impression for receiving the negative fastening contour 33. A special design of this fastening connection between spindle body 10 and entraining blade 20 is the latching connection 28', 32' already described above between entraining blade 20 and spindle body 10.

According to a further preferred embodiment of the fastening connection 29', 33' between entraining blade 20 and spindle body 10, the entraining blade 20 comprises a positive fastening contour 33'. This positive fastening contour 33' is shown schematically in FIG. 22. This positive fastening contour 33' is shaped such that it can receive a negative fastening contour 29' of the spindle body 10. The negative fastening contour 29' of the spindle body 10 is formed for example by a pin-like appendage, an axial projection or a similar construction, which extends in the axial direction of the spindle body 10 within the recess 30 in the direction of the entraining blade 20. The positive fastening contour 33' of the entraining blade 20 is designed compatible to this. According to FIG. 22, a preferred embodiment of the positive fastening contour 33' exists in a U-shaped contour, which encompasses the negative fastening contour 29'. It is also conceivable that the positive fastening contour 33' is formed by a ring-shaped construction, the enclosed ring surface of which is arranged perpendicular to the longitudinal axis of the entraining blade 20. Based on this arrangement, the positive negative fastening contour 29' can be received within the ring-shaped fastening contour 33'.

With respect to the latch bearing contours 28, 28', 32, 32' described above, it is also preferred to implement them as negative and positive fastening contours according to the FIGS. 21 and 22. A preferred embodiment thus also exists in fastening the entraining blade 20 in FIG. 22 within the recess 30 of the spindle body 10 by means of an adapter 40 or a pin 42.

The present invention also discloses a preferred production method for the tool 1 described above. One embodiment of this production method is shown by means of the flow chart in FIG. 21. In a first step S1, the spindle body 10 is produced with drive section 12 and receiving section 14 with thread 16. Known production methods are used for this, which do not need to be covered in greater detail here.

In a second step S2, the axial recess 30 within the receiving section 14 is produced with a one-sided radial window 34. According to a preferred embodiment, the axial recess 30 is created through eroding. The counter bearing 32; 32' is also eroded within the axial recess 30 according to a production alternative. It is also preferred to separately create the counter bearing 32; 32' as an adapter (see above) and to then press, glue or otherwise fasten it into the axial recess 30.

According to a further preferred production alternative, the receiving section 14 in step S2*a* is drilled open in the axial direction. The support sleeve 50 described above with the pin 42 is then inserted into the created bore hole so that the slot 52 of the support sleeve 50 forms the axial recess 30. It is also preferred to insert the pin 42 only after the insertion of the support sleeve 50 into the created bore hole. In this case, the pin 42 also runs through holes in the receiving section 14 in addition to the holes 54 in the support sleeve 50.

In a further step S3, the entraining blade 20 is produced with fastening contour 33; 33' or latch bearing contour 28, 28'. While other production methods for producing the entraining blade 20 with fastening contour 33; 33' or with latch bearing contour 28; 28' can also be used, the entraining blade 20 with fastening contour 33; 33' or latch bearing contour 28; 28' is preferably wire-eroded. According to a further preferred embodiment of the production step, the entraining blade 20 is produced in combination with the spring 24 as an integral structure. According to the design described above, this integral structure is preferably designed in a U-shaped manner. During the production of the entraining blade 20 with latch bearing contour 28; 28' or fastening contour 33; 33' or of the integral structure consisting of entraining blade 20 and spring 24, a positive fastening 33 or latch bearing contour 28, in particular a U-shaped latch bearing contour, or a negative fastening 33' or latch bearing contour 28', in particular an O-shaped latch bearing contour, is preferably provided on the entraining blade 20 (step S3).

In conclusion, a connecting of the fastening contour 33; 33' or latch bearing contour 28; 28' of the entraining blade 20 with a corresponding counter bearing 29, 29'; 32, 32' takes place in step S4 within the axial recess 30. The counter bearing is formed by a tang 32, a corresponding impression 32', an adapter 40 with tang 32, an axial appendage 33 or a pin 42, as described in detail above. The established connection between entraining blade 20 or integral structure with entraining blade 20 is manually establishable and also releasable again The present invention also discloses a preferred embodiment of a method for manually replacing the entraining blade 20 in the tool 1 described above based on the flow chart in FIG. 22. Regardless whether the entraining blade 20 is designed with fastening contour 33; 33' or latch bearing contour 28; 28' alone or as an integral structure in combination with the spring 24, a manual engagement of the entraining blade 20 in the axial recess 30 takes place in a first step I. In a second step II, the entraining blade 20 or the integral structure with entraining blade 20 and spring 24 is pulled out of the axial recess 30. Then, in a third step III, a new entraining blade 20 or a new integral structure with entraining blade 20 and spring 24 is manually inserted into the axial recess 30 and fastened or latched there in step IV. This replacing process for the entraining blade 20 requires no tool and is implementable in a short period of time. While for example a drift punch and a hammer are required for removing a pin holding the blade for tools of the state of the art, the entraining blade of the present invention can be removed with the help of the finger or the fingernail of the worker or a pen. Neither a tool nor complex and time-consuming working steps are necessary.

The invention claimed is:

1. A tool for installing or removing a tang-free wire thread insert, which has the following features:

a. a spindle body with a drive section and a receiving section, wherein the receiving section has one of a threaded and a threadless surface for receiving the wire thread insert, wherein the receiving section has an axial recess, the axial recess being open on a front side of the spindle body adjacent to the receiving section, the axial recess being open in a radial direction with respect to the spindle body, creating a radial window to the axial recess, the radial window being adjacent to the front side of the spindle body, b. an entraining blade, which is arranged in the axial recess of the receiving section, the entraining blade comprising a blade projection which is spring-mounted in an engaging position in the radial direction through a spring, so that the wire thread insert is engageable by means of the blade projection of the entraining blade through the radial window, while c. the entraining blade in the axial recess is fastenable and replaceable by means of a fastening connection between the entraining blade and the spindle body, wherein the fastening connection is designed as a latching or plug connection, which is manually establishable and releasable, wherein d. the entraining blade has one of a negative and positive fastening contour, which works together with a suitably designed mounting contour of the spindle body within the recess.

2. The tool according to claim 1, wherein the fastening contour of the entraining blade is one of a pin-like appendage and a ring-shaped opening and the mounting contour is one of a receiving impression and an axially extending projection.

3. The tool according to claim 1, wherein the entraining blade includes a latch bearing contour for the fastening connection on one side, with which the entraining blade is releasably latchable within the axial recess.

4. The tool according to claim 3, wherein the latch bearing contour is one of positively and negatively spring-loaded and works together respectively with a counter bearing, the counter bearing shaped complementarily to the latch bearing contour of the entraining blade.

5. The tool according to claim 4, wherein the counter bearing is integral with the spindle body within the axial recess or is fastened within the axial recess.

6. The tool according to claim 1, wherein the axial recess has one of a pressed in adapter and a pin extending transversely to a longitudinal axis of the receiving section, on which the entraining blade is fastenable.

7. The tool according to claim 1, in which the axial recess is a bore hole and in which a slotted support sleeve is fastened to the bore hole with a pin progressing transversely to a longitudinal direction of a slot of the sleeve for fastening the entraining blade.

8. The tool according to claim 1, wherein the entraining blade is designed in combination with the spring in a U-shaped manner so that at least one U-leg is formed by the entraining blade and another U-leg is formed by the spring.

9. The tool according to claim 8, the spring of which on an axial end comprises a radially outwards protruding projection, which extends in a longitudinal direction of the spring over a blade projection of the entraining blade.

10. The tool according to claim 8, the entraining blade and the spring of which form an integral structure.

11. The tool according to claim 1, wherein the manually establishable and releasable latching or plug connection is achievable by manually grasping of the entraining blade, pulling of the entraining blade out of the axial recess and manually inserting and fastening of another entraining blade in the axial recess.

12. A tool for installing or removing a tang-free wire thread insert, in which the tool has the following features:

a. a spindle body with a drive section and a receiving section, wherein the receiving section has one of a threaded and a threadless surface for receiving the wire thread insert, wherein the receiving section has an axial recess, the axial recess being open on the front side of the spindle body adjacent to the receiving section, the axial recess being open in a radial direction with respect to the spindle body creating a radial window to the axial recess, the radial window being adjacent to the front side of the spindle body, b. an entraining blade, which is arranged in the axial recess of the receiving section, the entraining blade comprising a blade projection that is spring-mounted in an engaging position in the radial direction through a spring, so that the wire thread insert is engageable by means of the blade projection of the entraining blade by means of the blade projection through the radial window, while c. the entraining blade is designed as one piece with the spring, and the entraining blade is manually fastenable and replaceable in the axial recess by means of a fastening connection between the entraining blade and the spindle body, wherein d. the entraining blade has one of a negative and positive fastening contour, which works together with a suitably designed mounting contour of the spindle body within the recess.

13. The tool according to claim 12, wherein the fastening contour of the entraining blade is one of a pin-like appendage and a ring-shaped opening and the mounting contour is one of a receiving impression and an axially extending projection.

14. The tool according to claim 12, in which the entraining blade has a latch bearing contour for the fastening connection on one side, with which the entraining blade is releasably latchable within the axial recess.

15. The tool according to claim 14, wherein the latch bearing contour is designed one of positively and negatively spring-loaded and works together respectively with a counter bearing, the counter bearing shaped complementarily to the latch bearing contour of the entraining blade.

16. The tool according to claim 15, in which the counter bearing is designed integrally in the spindle body within the axial recess or is fastened within the axial recess.

17. The tool according to claim 12, in which the axial recess has one of a pressed in adapter and a pin extending transversely to a longitudinal axis of the receiving section, on which the entraining blade is fastenable.

18. The tool according to claim 12, in which the axial recess is a bore hole, wherein a slotted support sleeve is fastened to the bore hole with a pin progressing transversely to a longitudinal direction of a slot of the sleeve for fastening the entraining blade.

19. The tool according to claim 12, in which the entraining blade is designed in combination with the spring in a U-shaped manner so that at least one U-leg is formed by the entraining blade and another U-leg is formed by the spring.

20. The tool according to claim 19, the spring of which on an axial end comprises a radially outwards protruding projection, which extends in a longitudinal direction of the spring over the blade projection of the entraining blade.

21. The tool according to claim 19, in which the entraining blade and the spring of which form an integral structure.

22. An entraining blade of a tool for installing and removing a tang-free wire thread insert, with which the tang-free wire thread insert is installable and removable, the entraining blade having a blade projection, and a fastening contour, the entraining blade is manually fastenable and replaceable in the tool by the fastening contour, wherein the fastening contour is designed as one of a latch bearing contour and one of a positive or a negative fastening contour of a plug connection, which is manually establishable and releasable and the entraining blade designed as one piece with a spring so that the entraining blade is spring-mountable in an engaging position in the tool.

23. The entraining blade according to claim 22, wherein the negative or positive fastening contour works together with a suitably designed mounting contour of a recess of a spindle body.

24. The entraining blade according to claim 23, in which the positive fastening contour of the entraining blade is one of a pin-like appendage and a ring-shaped opening.

25. The entraining blade according to claim 24, which is designed in combination with the spring in a U-shaped manner so that at least one U-leg is formed by the entraining blade and another U-leg is formed by the spring.

26. The entraining blade according to claim 25, in which the spring comprises a radially outwards protruding projection on an axial end, the radially outwards protruding projection extending in a longitudinal direction of the spring beyond the blade projection of the entraining blade.

27. The entraining blade according to claim 23, which is designed in combination with the spring in a U-shaped manner so that at least one U-leg is formed by the entraining blade and another U-leg is formed by the spring.

28. The entraining blade according to claim 27, in which the spring comprises a radially outwards protruding projection on an axial end, the radially outwards protruding projection extending in a longitudinal direction of the spring beyond the blade projection of the entraining blade.

29. The entraining blade according to claim 22, wherein the latch bearing contour is designed as one of positively and negatively spring-loaded.

30. The entraining blade according to claim 29, which is designed in combination with the spring in a U-shaped manner so that at least one U-leg is formed by the entraining blade and another U-leg is formed by the spring.

31. The entraining blade according to claim 30, in which the spring comprises a radially outwards protruding projection on an axial end, the radially outwards protruding projection extending in a longitudinal direction of the spring beyond the blade projection of the entraining blade.

32. The entraining blade according to claim 22, which is designed in combination with the spring in a U-shaped manner so that at least one U-leg is formed by the entraining blade and another U-leg is formed by the spring.

33. The entraining blade according to claim 32, in which the spring comprises a radially outwards protruding projection on an axial end, the radially outwards protruding projection extending in a longitudinal direction of the spring beyond the blade projection of the entraining blade.

34. The entraining blade according to claim 32, in which the entraining blade and the spring form an integral structure.

* * * * *